United States Patent [19]

Sclippa

[11] 4,408,266

[45] Oct. 4, 1983

[54] OPTICAL SYSTEM FOR AIRPORT SEMI-FLUSH APPROACH LIGHTS

[76] Inventor: Ermes Sclippa, R.R. #6, Guelph, Ontario, Canada, N1H 6J3

[21] Appl. No.: 252,364

[22] Filed: Apr. 9, 1981

[51] Int. Cl.[3] ..... F21V 7/08

[52] U.S. Cl. ..... 362/297; 362/62; 362/346; 362/195; 362/350; 362/308; 362/362; 362/310; 362/328; 362/329; 362/344

[58] Field of Search ..... 362/62, 135, 140, 145, 362/297, 9, 305, 304, 310, 329, 339, 346, 308, 328, 364, 344, 350

[56] References Cited

U.S. PATENT DOCUMENTS

| | | | |
|---|---|---|---|
| 2,645,706 | 7/1953 | Bowland | 362/135 |
| 3,250,907 | 5/1966 | Keck et al. | 362/364 X |
| 3,369,112 | 2/1968 | Loch | 362/297 |
| 3,586,849 | 6/1971 | Starkweather | 362/297 X |
| 3,678,260 | 7/1972 | Beal | 362/267 |
| 3,697,736 | 10/1972 | Frederiksen | 362/339 X |
| 4,161,770 | 7/1979 | Maurer | 362/62 X |
| 4,180,850 | 12/1979 | Bivens | 362/145 X |
| 4,218,727 | 8/1980 | Shemitz et al. | 362/346 X |
| 4,295,186 | 10/1981 | Sugiura et al. | 362/297 X |

*Primary Examiner*—Peter A. Nelson

[57] ABSTRACT

This invention relates to a threshold and approach semi-flush light of the type which utilizes a high intensity lamp surrounded by a reflector which concentrates the light emitting from the lamp on a mirror located above the lamp. The mirror reflects the light through a prism in a predetermined pattern. The reflector comprises a pair of ellipsoidal surfaces of differing eccentricities joined together to form a composite reflector, such that the ellipsoidal section nearest the lamp filament has an eccentricity greater than the second ellipsoidal section spaced a greater distance away from the lamp filament.

3 Claims, 2 Drawing Figures

OPTICAL SYSTEM FOR AIRPORT SEMI-FLUSH APPROACH LIGHTS

BACKGROUND OF THE INVENTION

Lights in the approach area of a runway have been until recently mounted above the ground. With the advent of the large jet aircraft, runways have been extended for take off and the threshold and some approach lights previously mounted above the ground now must be recessed semi-flush into the extended runway surface. These lights house high power quartz lamps which generate a sizable quantity of heat which must be dissipated by the fixture. The light fixture itself must also be rugged enough to carry the weights of heavy jet aircraft using the runway extension. The light emitted from the threshold and approach lights must be in accordance with a predetermined pattern.

PRIOR ART

U.S. Pat. No. 3,678,260 issued July 18, 1972.

SUMMARY

The optical system of this invention is housed in a rugged structure which is able to support the weight of heavy aircraft rolling over it. Generally, the light source is a high power quartz halogen incandescent lamp and the light is reflected and focused upwardly by a multielliptical reflector to a mirror which in turn reflects the received light through a prism to atmosphere. The reflector of the optical system of the present invention is formed of a pair of axially connected portions of ellipsoidal surfaces of revolution which are coaxially disposed and have different eccentricities, the lowermost surface being closest to the lamp having the greatest eccentricity.

DESCRIPTION OF PREFERRED EMBODIMENT OF THE INVENTION

Figure 1:
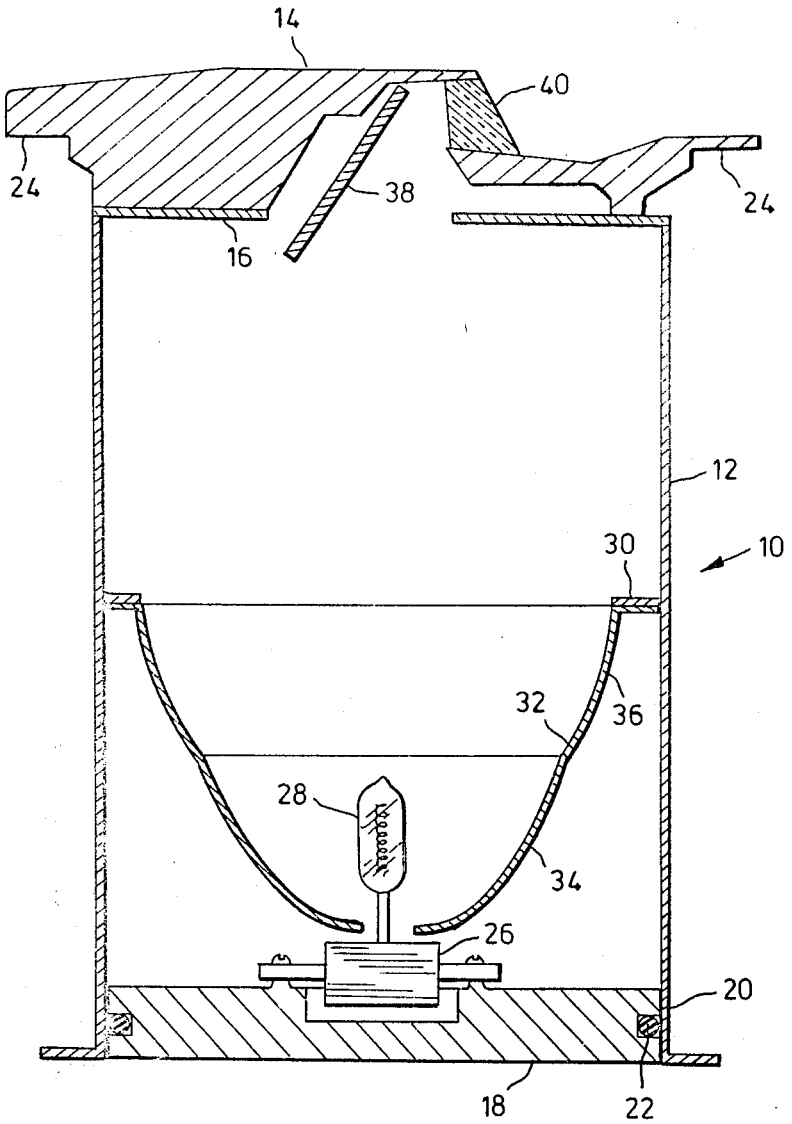
FIG. 1 shows a partial sectional elevational view of the runway light of this invention.

As shown in FIG. 1 the approach light 10 is housed in an enclosure 12 having a heavy metal casting 14 sealedly connected to the top surface 16 of the enclosure 12 and a second metal casting 18 sealedly connected to the lower portion 20 of housing 12. The seal at the lower end of the housing may be accomplished by "O" ring 22. The whole structure described above may be mounted at flange 24 in a second cylinder to provide support to prevent collapse of enclosure 12 when great weight is put on casting 14.

Mounted on casting 18 is a lampholder 26 to hold and position a high intensity quartz lamp 28. Surrounding lamp 28 and secured to housing 12 at a ring 30 is reflector 32 which is composed of a pair of ellipsoidal surfaces of revolution 34 and 36.

Light collected by reflector 32 is directed to dichroic mirror 38 which subsequently reflects the light received through exit prism 40. Mirror 38 is adjustable in angle so that the elevation angle of emitted light from the exit prism is adjustable.

The aviation authorities set very stringent photometric requirements on the light beam exiting through the prism 40, and thus a very intense light source 28 is required to produce the required light pattern and a fairly sophisticated reflector 32 is required to gather the light energy emitted from source 28. The reflector of this invention is manufactured such that ellipsoidal section 36 has less eccentricity than section 34, this feature is probably best illustrated in FIG. 2.

It will be seen that the reflector 32 comprises a pair of ellipsoidal surfaces of revolution which are produced in such a manner that the foci are not coincident on the lamp filament. Because the filament of the quartz lamp is not a true point source, but a coil of approximately one half inch in length, it will be found to be advantageous to space the foci of the two elliptical sections apart by a distance of approximately 3/16 to one quarter of an inch to thus improve the light gathering capacities of each reflecting section. Thus the light gathering section 34 which is a part of ellipsoidal section $E_1$ will have a focus $F_1$ which will be placed approximately 3/16 of an inch below focus $F_2$ the focus for ellipsoidal section $E_2$. The filament of lamp 28 will be placed so that the foci $F_1$ and $F_2$ are equidistantly spaced from each of their respective ends of the filament.

Figure 2:
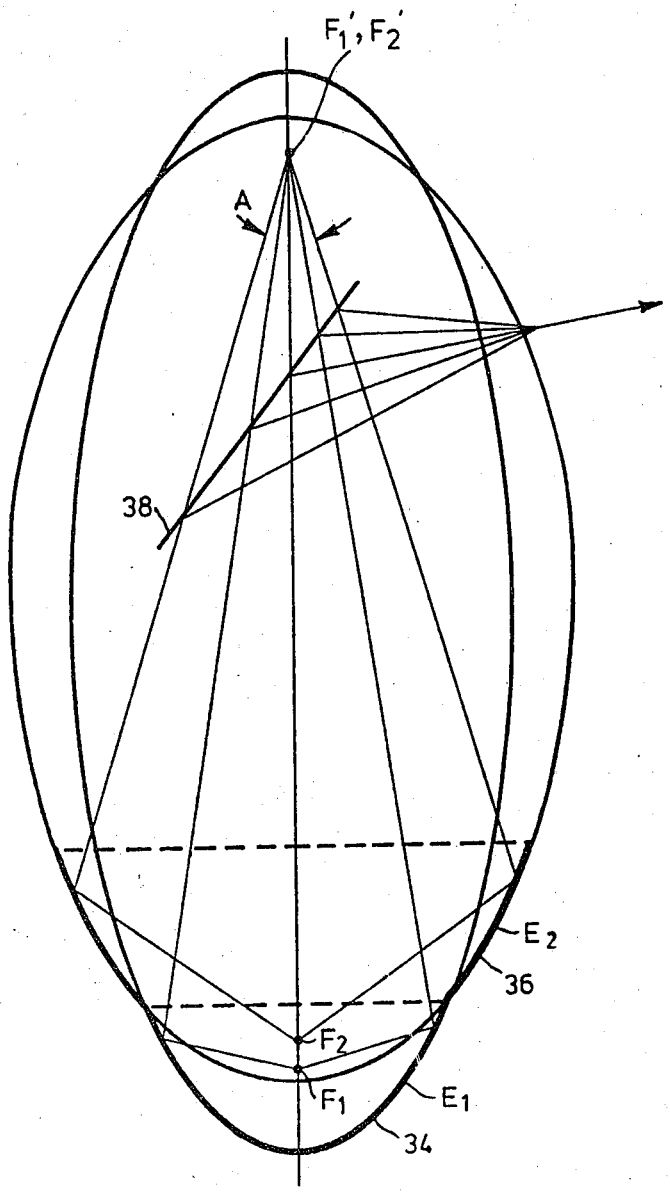
FIG. 2 is an illustration of the optical characteristics of the reflector utilized in this invention.

As can be seen in FIG. 2 the conjugate foci $F_1$ and $F_2$ are chosen to be coincident, so that the major axes of the two ellipses $E_1$ and $E_2$ are of necessity coincident. The location of the two conjugate foci is determined by the desired convergence angle of the light beam being focused by the ellipsoidal surfaces $E_1$ and $E_2$. The beam convergence angle will generally be set by the aviation authority specifications.

It will be seen that the reflector of this invention is a departure from the prior art, in that previously it was thought desirable to have the ellipsoidal reflecting portion having the least eccentricity nearest the filament of the lamp.

It is thus seen that this invention seeks to improve the light collecting and beam focusing of a threshold airport runway light so that a maximum output of light energy is obtained and the beam pattern of the emitted light is more closely controlled.

By making allowances for the non-point source of light which provides the light energy for the fixture, the combined elliptical sections are chosen to collect and focus a maximum amount of light emitted from the filament to a single point in space. The choice of the two ellipsoidal sections is a departure from the teachings of the prior art and it is believed that the improved performance from the threshold fixture represents a substantial departure from the prior teachings in this art.

I claim:

1. An optical system suited for an aircraft guidance lighting fixture, comprising a lamp, a reflector, a mirror and an exit prism, said lamp being of the high intensity incandescent type, having an elongated filament of finite length, said lamp and said reflector being mounted in said fixture such that said reflector surrounds said lamp, said reflector having a plurality of ellipsoidal surface portions of differing eccentricities, such that the surface portions are axially displaced relative to each other to reflect light from said lamp in the same general direction, the major axes of each of the ellipsoidal surface portions being coincident and passing through the axis of said elongated filament, a focus of each ellipsoidal surface portion being located on said filament and spaced apart equidistantly from each end of said filament, the ellipsoidal surface portion having the greatest eccentricity being located nearest the filament of said lamp, and the conjugate foci of said ellipsoidal surface portions being coincident in space said mirror lying on said major axes at an adjustable angle of substantially forty five degrees to said axes arranged to reflect light from said lamp through said prism and thus substantially at right angles to said major axes.

2. The system of claim 1 wherein said reflector comprises only two ellipsoidal surface portions.

3. The system of claim 1 or claim 2 wherein said mirror is located between said reflector and said conjugate foci.

* * * * *